US008336991B2

(12) United States Patent
Izawa et al.

(10) Patent No.: US 8,336,991 B2
(45) Date of Patent: Dec. 25, 2012

(54) INK JET PRINTER

(75) Inventors: Hideo Izawa, Narashino (JP); Takao Namiki, Narashino (JP); Kouichi Ooyama, Yokote (JP); Masahito Sato, Yokote (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 106 days.

(21) Appl. No.: 12/986,575

(22) Filed: Jan. 7, 2011

(65) Prior Publication Data

US 2011/0181662 A1 Jul. 28, 2011

(30) Foreign Application Priority Data

Jan. 27, 2010 (JP) ..... 2010-015673

(51) Int. Cl.
*B41J 2/155* (2006.01)

(52) U.S. Cl. ..... 347/42; 347/40

(58) Field of Classification Search ..... 347/20, 347/40, 42, 43, 49
See application file for complete search history.

(56) References Cited

U.S. PATENT DOCUMENTS

| | | | | |
|---|---|---|---|---|
| 6,089,696 | A * | 7/2000 | Lubinsky | 347/40 |
| 6,174,044 | B1 * | 1/2001 | Yun | 347/40 |
| 6,663,222 | B2 * | 12/2003 | Verhoest et al. | 347/40 |
| 2005/0280678 | A1 | 12/2005 | Bibl et al. | |
| 2008/0143768 | A1 | 6/2008 | Veenstra et al. | |

FOREIGN PATENT DOCUMENTS

| | | | |
|---|---|---|---|
| EP | 0440469 | A2 | 8/1991 |
| JP | 2644064 | B2 | 8/1997 |

OTHER PUBLICATIONS

European Search Report dated Mar. 8, 2011, issued in corresponding European Patent Application No. 11150564.

* cited by examiner

*Primary Examiner* — Thinh Nguyen
(74) *Attorney, Agent, or Firm* — Westerman, Hattori, Daniels & Adrian, LLP

(57) ABSTRACT

In an ink jet printer having a plural number of line heads arranged in a paper printing direction, it is sought to render the printing density high in the nozzle row direction without the need to exchange the line heads.
The invention provides an ink jet printer in which line heads other than at least one of the line heads 3 are each displaceable by a distance that is equal to a part per the plural number of a nozzle pitch in the line head in a direction of the nozzle row.

3 Claims, 5 Drawing Sheets

INK JET PRINTER

TECHNICAL FIELD

The present invention relates to an ink jet printer that comprises a plural number of line heads arranged parallel to one another in a paper printing direction.

BACKGROUND ART

Printing at higher speed in an ink jet printer makes it necessary to increase the speed of travel of a paper web in its printing direction and to decrease the interval between ink jets. Due to a limit for the frequency of voltage signal for ink jet, however, there is a limitation of decreasing the interval between ink jets. In JP 2,644,064 B, there is disclosed a printer in which a plural number of ink jet heads are arranged in a paper printing direction to print in a state that their ink jet heads complement one another, thereby to raise the printing speed while maintaining a printing density of, e, g., 600 dpi, constant in the paper traveling direction.

In the prior art mentioned above, two ink jet heads are arranged in two rows in the paper printing direction. With one ink jet head of them designed to deliver ink jets roughly to attain a printing density of 300 dpi at a maximum speed of travel of paper, the other ink jet head likewise designed to deliver ink jets at the 300 dpi printing density gives rises to increasing the printing density in the paper printing direction by doubling it, to 600 dpi. Then, dropping the printing speed (printing length per unit time) to one half while maintaining the ink jet interval at a minimum further raises the printing density in the paper printing direction to 1,200 dpi. However, the printing density in the direction (direction of paper width) orthogonal to the printing direction, namely in the direction of a nozzle row is fixed by the nozzle pitch; for example, a printing density of 600 dpi with a nozzle pitch of 0.042. Thus, while the printing density in the paper printing direction can be increased to 1,200 dpi, the printing density in the nozzle row direction remains at 600 dpi and cannot be raised. To effect printing at a high density of 1,200 dpi×1,200 dpi, therefore, there is a need to exchange with a separately prepared ink jet head having a nozzle pitch corresponding to the printing density of 1,200 dpi. However, it is difficult to maintain the accuracy of the ink jet head position after exchange thereof and time and work are necessary to adjust its accuracy.

With the aforementioned taken into account, it is an object of the present invention to provide an ink jet printer comprising a plural number of line heads arranged in a paper printing direction, each line head having a row of ink jet nozzles, in which for a mode of printing at a high definition in the paper printing direction due to a lowered printing speed, the printing density in a direction of the nozzle row can be rendered high in a simple operation and without the need to replace with such a head.

DISCLOSURE OF THE INVENTION

In order to achieve the object mentioned above, there is provided in accordance with the present invention an ink jet printer in which a plural number of line heads, each provided in a row with a multitude of ink jet nozzles, are arranged in a printing direction, characterized in that such line heads other than at least one of the line heads are each displaceable by a distance that is equal to a part per the plural number of a nozzle pitch in a line head in a direction of the nozzle row.

And, in a high definition mode at a lowered printing speed, such line heads with respect to their respective adjacent line heads are successively displaced by a distance that is equal to a part per the plural number of the nozzle pitch in the line head in a direction of the nozzle row, whereby a nozzle pitch of the line heads in the nozzle row direction is shortened.

The present invention also provides an ink jet printer so constructed as mentioned above and which comprises: a line head displaceable in the nozzle row direction, the line head being provided at its one end in the nozzle row direction with a V shaped flange having a V shaped grove faced outwards in the nozzle row direction; a positioning pin fastened to a positioning block and engaged in the V shaped groove of the V shaped flange; and an eccentric shaft of an eccentric pin rotatably supported on a line block frame, the eccentric shaft receiving and supporting the positioning block, whereby an eccentric rotation of the eccentric shaft by a rotation of the eccentric pin moves the positioning block in the nozzle row direction so as to move the positioning pin in the nozzle row direction, thereby displacing via the V shaped flange the line head in the nozzle row direction. And, in the ink jet printer the eccentric pin may be made accessible for operation from an underside of the line block frame.

According to the present invention, an ink jet printer in which a plural number of line heads each provided in a row with a multitude of ink jet nozzles are arranged in a printing direction is improved in that such line heads other than at least one of the line heads are each displaced by a distance that is equal to a part per the plural number of a nozzle pitch in a line head in a direction of the nozzle row. Thus, where printing is effected in a mode at a lowered printing speed to achieve a high printing density in the paper printing direction, the printing density in the nozzle row direction can thereby be rendered high, without the need to replace a line head block and in a simple operation, to a printing density equal to that in the paper printing direction.

And, according to the present invention, the ink jet printer is further improved in that where printing is effected at high definition in the paper printing direction, such line heads with respect to their respective adjacent line heads are successively displaced by a distance that is equal to a part per the plural number of a nozzle pitch in the line head in a direction of the nozzle row, whereby a nozzle pitch of the line heads in the nozzle row direction is shortened. Thus, printing in the nozzle row can also be effected at high definition.

Also, displacement of a respective line head in the nozzle row direction can be effected simply and at finely sized spacings by rotary movement of an eccentric pin. Moreover, the eccentric pin can be simply operated from an underside of the line block frame.

BEST MODES FOR CARRYING OUT THE INVENTION

Figure 1:
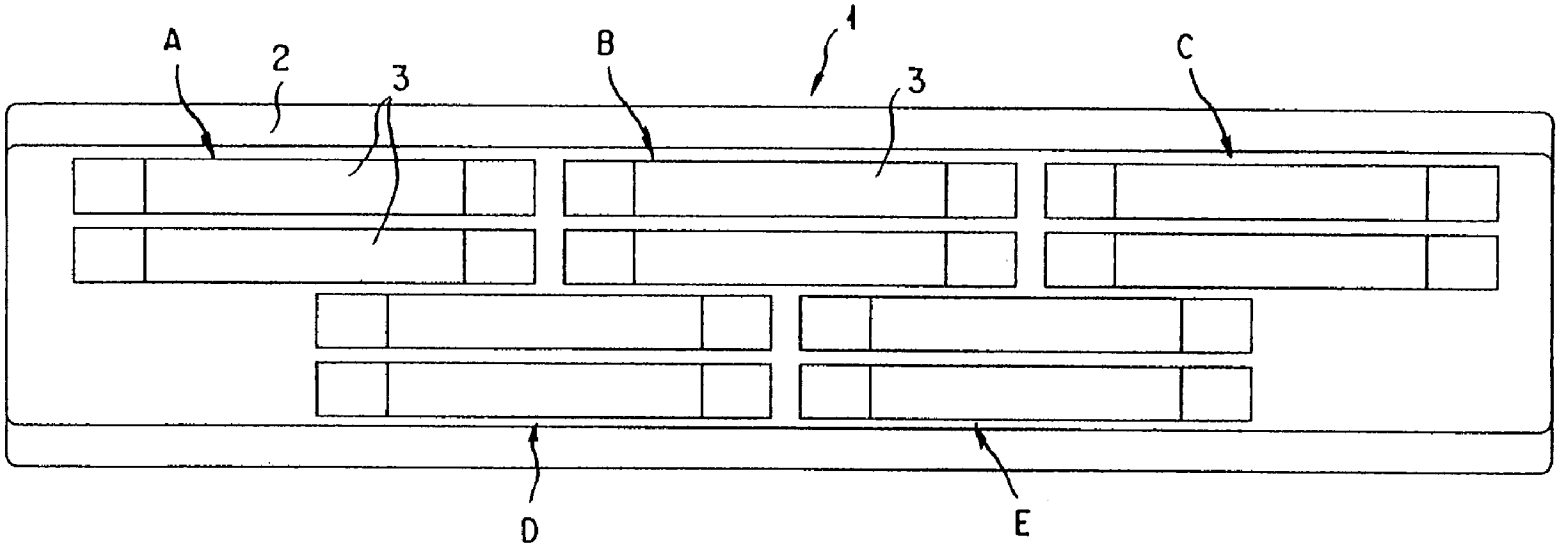
FIG. 1 is a plan view diagrammatically illustrating one form of implementation of an ink jet printer according to the present invention.

Referring to the drawing Figures, an explanation is given of one form of the present invention.

FIG. 1 shows a line head assembly 1 in the form of implementation of an ink jet printer according to the present invention. The line head assembly 1 comprises a line block frame 2 provided with a plural number of line heads 3, each of which has a multitude of ink nozzles arranged linearly on its nozzle surface in a direction orthogonal to a paper printing direction and whose number is such as to cover an entire width of the printing surface of a web of paper.

In this form of implementation, there are arranged five head blocks A, B, C, D and E each of which is constituted of a pair of line heads 3 and 3 juxtaposed in the paper printing direction (in the direction in which the web of paper is traveling). Of them, three head blocks A, B and C are arranged spaced apart in the nozzle row direction and the other two head blocks D and E so spaced apart are arranged shifted in the paper printing direction so as to cover the spaces between two adjacent blocks of those three blocks A, B and C.

One head block is constituted of a pair of line heads 3, and each line head 3 is so mounted on the line block frame 2 that it can be displaced by a stroke that is one half of the nozzle pitch in a direction orthogonal to the paper printing direction, namely in a nozzle row direction.

Figure 2:
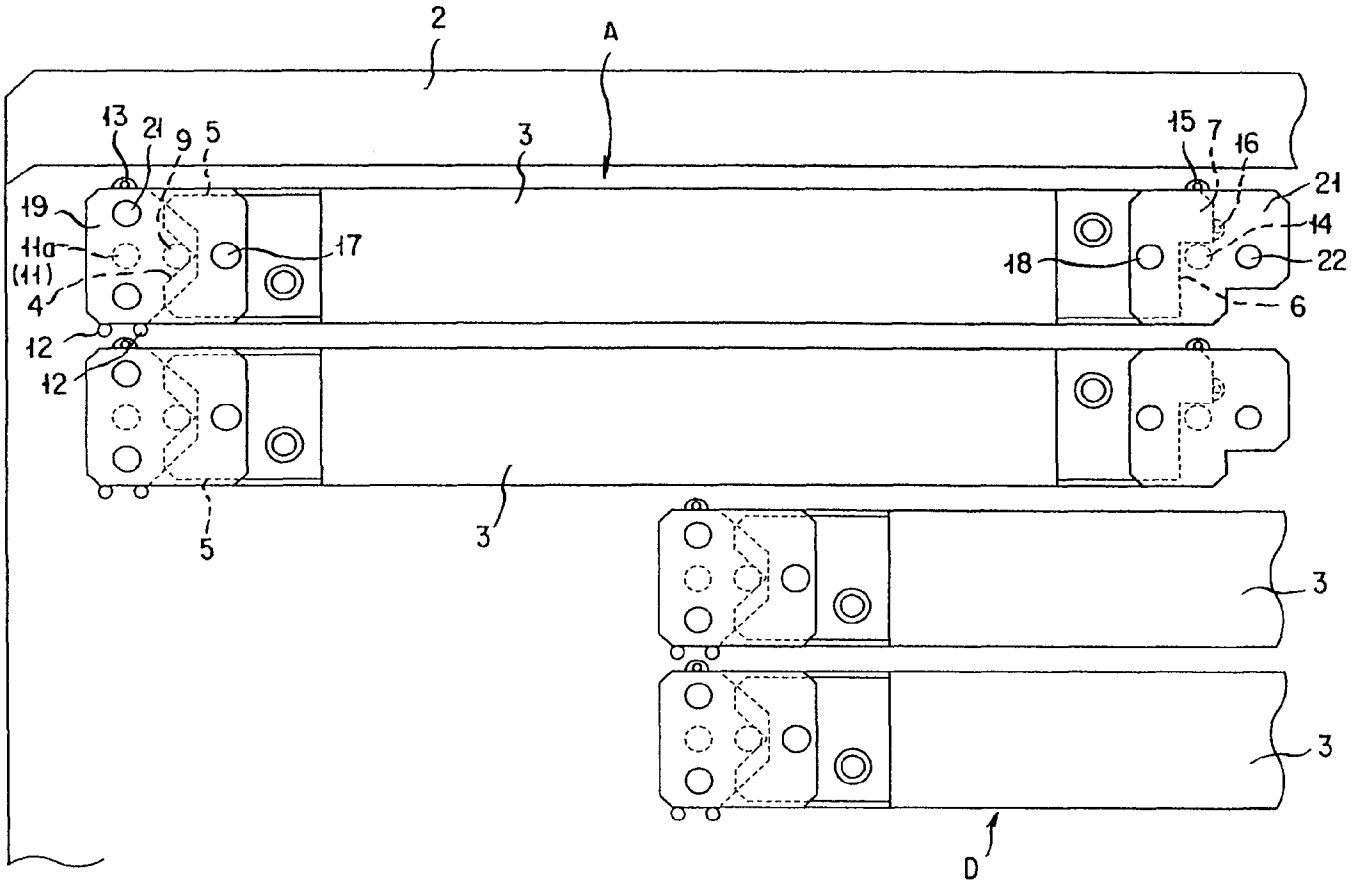
FIG. 2 is a plan view of an essential part of the form of implementation shown as enlarged.
Figure 3:
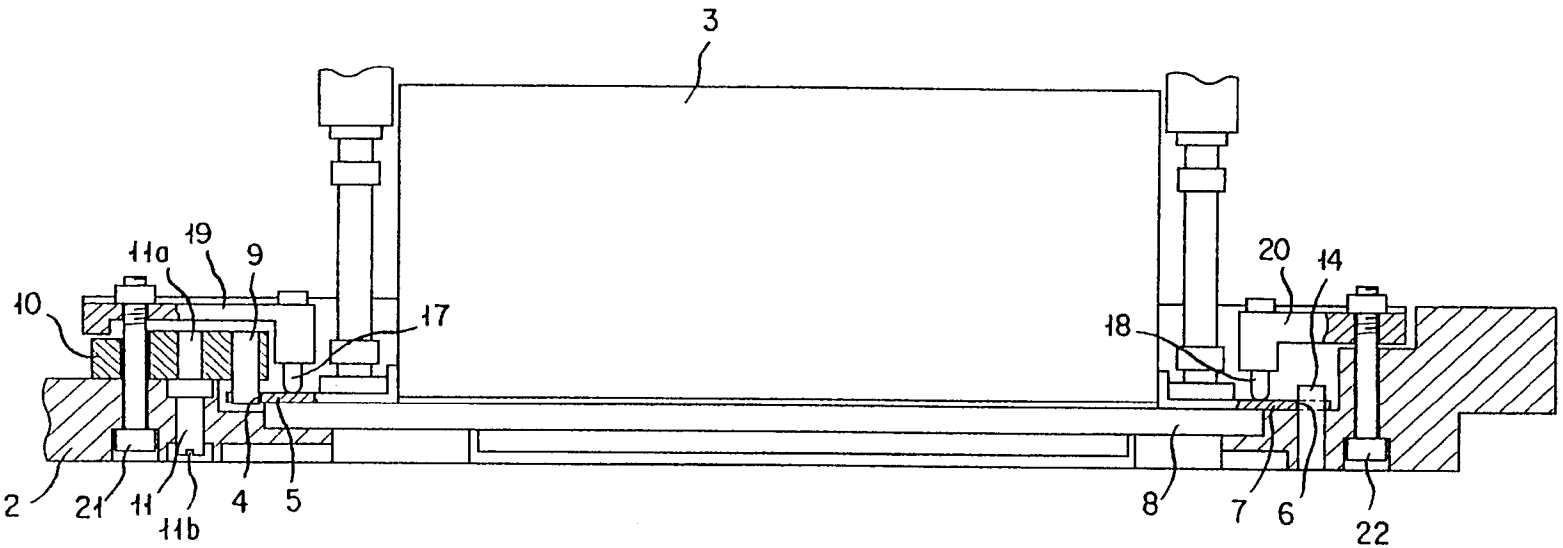
FIG. 3 is a cross sectional view of the essential part of the form of implementation shown as enlarged.

The line heads 3 are mounted in a structure as shown in FIGS. 2 and 3.

Each line head 3 is provided at its one end in the nozzle row direction with a V shaped flange 5 formed with a V shaped grove 4 open outwards in the nozzle row direction and at its other end with an L shaped flange 7 formed with an L shaped cutout 6. And, these flanges 5 and 7 are placed on the line block frame 2 via a support plate 8.

And, the V shaped groove 4 of the V shaped flange 5 has a first positioning pin 9 engaged therewith externally in the nozzle row direction. The first positioning pin 9 is fastened to a positioning block 10 placed on the line block frame 2 movably in the nozzle row direction. And, the positioning block 10 is fitted with and supported by an eccentric shaft 11*a* of an eccentric pin 11 mounted rotatably standing on the line block frame 2 so that rotating the eccentric pin 1 upon engaging a driver with a driver groove 11*b* formed at its lower end rotates the eccentric shaft 11*a* eccentrically, thereby moving the positioning block 10 in the nozzle row direction. Moreover, the eccentric pin shaft 11*a* is rendered somewhat displaceable relative to the positioning block 10 in the paper printing direction.

Figure 4:
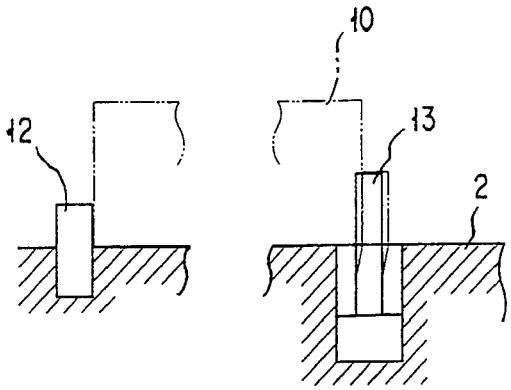
FIG. 4 is an explanatory view illustrating a relation between a spring pin and a support pin the form of implementation.

One side surface of the positioning block 10 in the paper printing direction is made in contact with a pair of support pins 12 and 12 standing on the line block frame 2 and its other side surface is made in contact with a spring pin 13 standing on the line block frame 2 for biasing the positioning block 10 towards the support pins 12 and 12, thus making the positioning block 10 positionable in the paper printing direction as shown in FIG. 4.

On the other hand, the L shaped cutout 6 of the L shaped flange 7 in the line head 3 has a second positioning pin 14 engaged and made in contact with its one side surface in line with the paper printing direction of the line head 3. The second positioning pin 14 is mounted standing on the line block frame 2. Also, in contact with a side surface of the L shaped flange 7 opposite to that in contact with the second positioning pin 14, there is provided a spring pin 15 standing on the line block frame 2 and biasing towards the second positioning pin 14 the L shaped flange 7. Further, a spring pin 16 standing on the line block frame 2 is provided to contact with a tip of the L shaped flange 7, thereby elastically supporting a force by the first positioning pin 9 tending to move the line head 3 in the nozzle row direction.

At both ends of the line head 3 in the nozzle row direction there are provided a first and a second fixing pins 17 and 18 to hold the upper surfaces of both flanges 5 and 7 and thereby to fix them, respectively, of the line head 3 set in position by the first and second positioning pins 9 and 14 as mentioned above. The fixing pins 17 and 18 are fastened to brackets 19 and 20, respectively. The brackets 19 and 20 are fixed to the line block frame 2 by fixing bolts 21 and 22, respectively, to allow each flange 5, 7 to be fixed onto the line block frame 2 by each fixing pin 17, 18.

Figure 5A:
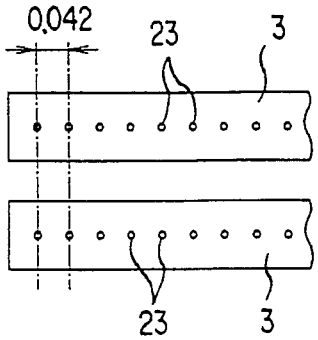
FIG. 5A is a view of arrangement of ink nozzles where two line heads lie placed at an identical position in the direction of the nozzle rows.

In the makeup mentioned above, the line heads 3 and 3 of each head block A, B, C, D, E are arranged juxtaposed in the paper printing direction, extending parallel in the nozzle row direction. Conventionally, as shown in FIG. 5A there are pairs of nozzles 23 and 23 of both line heads 3 and 3 where two nozzles of each pair in the paper printing direction are identical in position in the nozzle row direction. And, the nozzles in each row are spaced by a nozzle pitch of, e. g., 0.042 mm, then a web of paper moved to travel at a given speed will be printed at a printing density of 600 dpi.

Then, dropping the speed of travel of the web of paper to one half doubles the printing density in the paper printing direction to 1200 dpi but leaves the printing density in the nozzle row direction to remain at 600 dpi with the nozzle pitch unchanged, and it is not possible to increase the printing density in the nozzle row direction in conformance with its increase in the paper printing direction.

Figure 5B:
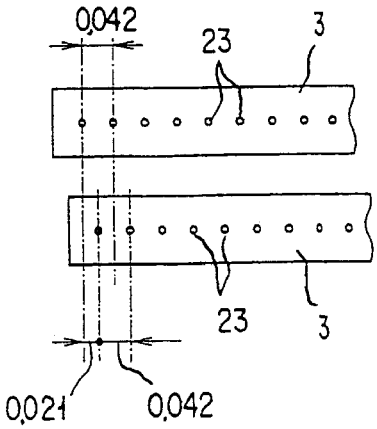
FIG. 5B is a diagrammatic view illustrating the state of two line head that they lie displaced from each other a distance that is one half of the nozzle pitch in the direction of the nozzle rows in the form of implementation.

The present invention is accordingly provided applied to high definition printing in which as shown in FIG. 5B one of two line heads 3 and 3 that constitute each of head blocks A to E is displaced by a distance that is equal to one half of the nozzle pitch of the line head 3, 3 in the nozzle row direction. Then, for one designated line head in each head block the other line head is so displaced.

This causes two line heads 3 and 3 to reduce the nozzle pitch in the nozzle row direction to one half with a single line head and to double the printing density in the nozzle row direction, namely to 1200 dpi. However, displacing one line head 3 in the nozzle row direction will bring about the state that there is only one nozzle 23 in the paper printing direction, namely that there is substantially one line head, i. e., a printing density of 600 dpi in the paper printing direction. Then, reducing the speed of travel of paper further to one half will return the printing density in the paper printing direction to 1200 dpi. High definition printing at 1200 dpi×1200 dpi will be thus achieved. In this connection, note further that displacing a line head 3 in the nozzle row direction is effected not only for high definition printing but also to correct the printing position deviated in the nozzle row direction due to changes in machine and atmospheric temperatures.

Mention is made below of the displacement operation of the line head 3.

First, after the ink jet printer is moved to its maintenance position, the fixing bolts 21 and 22 at both sides in the nozzle row direction are loosened from the underside of the printer to release both flanges 5 and 7 from holding with the first and second fixing pins 17 and 18. After that, a driver is brought into engagement with the driver groove 11*b* of the eccentric pin 11 likewise from the underside of the printer, and the eccentric pin 11 is rotated.

The eccentric shaft 11*a* is thereby eccentrically rotated to move the positioning block 10, causing the positioning pin 9 fastened thereto to push the V shaped flange 5, thereby displacing the line head 3 in the nozzle row direction. There is then set a displacement that is equal to one half of the nozzle pitch, namely that is 0.021 mm.

Figure 6:
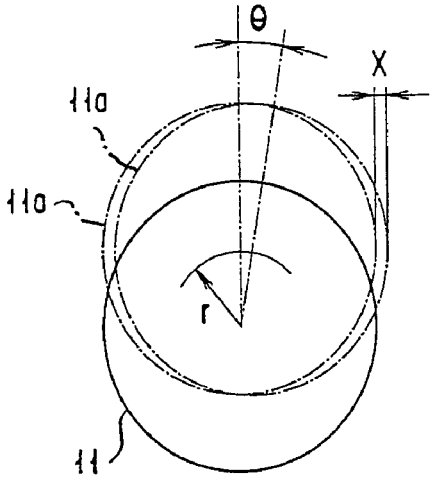
FIG. 6 is a functional explanatory view of an eccentric pin in the form of implementation.

Mention is made of relationship between an amount of eccentricity of the eccentric shaft 11*a* of the eccentric pin 11, an angle of its rotation θ and a displacement thereof x with reference to FIG. 6.

In FIG. 6, let it be assumed that the amount of eccentricity r of the eccentric shaft 11*a* from the eccentric pin 11 is 0.1 mm. Then, the displacement x by the eccentric shaft 11*a* becomes (0.1×sin θ). In order to yield 0.021 mm as the displacement, the angle of rotation θ of the eccentric pin 11 is about 12 degrees. Thus, to displace the line head 3 in the nozzle row direction by 0.021 mm, the eccentric pin 11 is rotated by 12 degrees in a direction in which the eccentric shaft 11*a* is moved in the nozzle row direction.

While in the illustration above, mention is made of two line heads 3 constituting each head block, an ink jet printer may have three or more line heads 3 arranged in the paper printing direction to achieve higher definition printing. Then, with respect to a given reference line head, the other line heads are rearranged which are displaced successively in the nozzle row direction by a distance that is equal to 1/n (where n is the number of line heads) of the nozzle pitch in a line head to effect printing at a density according to the number of line heads.

For example, in a printer with three line heads 3 arranged in three rows, the inter-nozzle spacing of nozzles in combination of adjacent line heads 3 and 3 is set at ⅓ of that of nozzles in a line head, namely at 0.014 mm. With the eccentric pin 11, its angle of rotation to effect a displacement of 0.014 is 8 degrees. Thus, with respect to the reference line head, the first line head 3 has its eccentric pin 11 rotated by 8 degrees and the second line head 3 has its eccentric pin 11 rotated by 16 degrees whereby the nozzle pitch then in the nozzle row direction becomes 0.014 mm that is one third of that in a line head to achieve high definition printing.

Displacements of two line heads 3 and 3 in the nozzle row direction lead to a state that there in substance is only one line head 3 in the paper printing direction, reducing the printing density in the paper printing direction to one third. Then, as in the above, by dropping the speed of travel of the paper to one third, the printing density in the paper printing direction is recovered.

Figure 7:
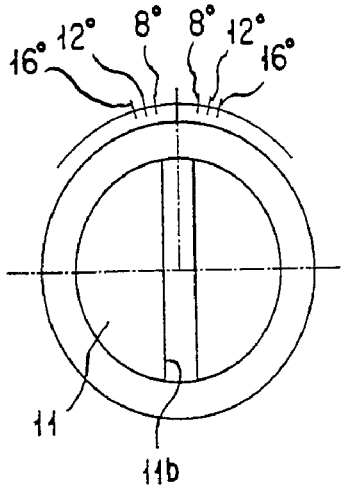
FIG. 7 is an explanatory view of a rotary operating part of the eccentric pin in the form of implementation.

The eccentric pin 11 is accessible from the underside of the printer for operation with a driver engaging with its driver groove 11*b* as mentioned above. As a measure of rotation then, it is convenient to provide as shown in FIG. 7 a scale of rotation in the periphery of a hole of the line block frame 2 in which the eccentric pin 11 is received.

Further, the recognition of a displacement of a line head 3 may be effected by reading an angle of rotation of the eccentric pin 11 as mentioned above. Alternatively, a separate displacement detection means such as dial gauge may be provided around a line head 3 for reading its scale.

Further, although in the form of implementation illustrated above, a plural number of line heads arranged in the paper printing direction are rendered each displaceable in the nozzle row direction, the makeup may be adopted in which a single reference line head is fixed in position and rendered not displaceable.

What is claimed is:

1. An ink jet printer, comprising:

a plural number of line heads, each provided in a row with a multitude of ink jet nozzles, and wherein said line heads are disposed in a printing direction, said line heads, other than least one of said line heads, are each displaceable by a distance that is equal to a part per the plural number of a nozzle pitch in a said line head in a direction of the nozzle row;

a line head displaceable in the nozzle row direction, the line head being provided at one end thereof, in the nozzle row direction with a V shaped flange having a V shaped grove faced outwards in the nozzle row direction;

a positioning pin fastened to a positioning block and engaged in the V shaped groove of the V shaped flange; and an eccentric shaft of an eccentric pin rotatably supported on a line block frame, said eccentric shaft receiving and supporting said positioning block, whereby an eccentric rotation of the eccentric shaft by a rotation of the eccentric pin moves said positioning block in the nozzle row direction so as to move said positioning pin in the nozzle row direction, thereby displacing via the V shaped flange the line head in the nozzle row direction.

2. An ink jet printer as set forth in claim 1, wherein said eccentric pin is accessible for operation from an underside of said line block frame.

3. An ink jet printer as set forth in claim 1, wherein when the ink jet printer is in a high definition mode at a lowered printing speed, each line head with respect to a respective adjacent line head is successively displaced by a distance that is equal to a part per the plural number of the nozzle pitch in the line head in a direction of the nozzle row, whereby a nozzle pitch of said line heads in the nozzle row direction is shortened.

* * * * *